US011426040B2

(12) United States Patent
Park et al.

(10) Patent No.: US 11,426,040 B2
(45) Date of Patent: Aug. 30, 2022

(54) CLEANING APPARATUS

(71) Applicant: LG ELECTRONICS INC., Seoul (KR)

(72) Inventors: Jiho Park, Seoul (KR); Jinrae Cho, Seoul (KR); Hyo Chul Shin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/130,511

(22) Filed: Dec. 22, 2020

(65) Prior Publication Data

US 2021/0219799 A1 Jul. 22, 2021

(30) Foreign Application Priority Data

Jan. 17, 2020 (KR) ..... 10-2020-0006623

(51) Int. Cl.

| | |
|---|---|
| ***A47L 9/00*** | (2006.01) |
| ***A47L 5/24*** | (2006.01) |
| ***A47L 9/28*** | (2006.01) |

(52) U.S. Cl.

CPC ..... *A47L 9/0063* (2013.01); *A47L 5/24* (2013.01); *A47L 9/2873* (2013.01); *A47L 9/2884* (2013.01)

(58) Field of Classification Search

None

See application file for complete search history.

(56) References Cited

U.S. PATENT DOCUMENTS

| | | | | |
|---|---|---|---|---|
| D863,703 | S * | 10/2019 | Wang | D32/31 |
| 2017/0319034 | A1* | 11/2017 | Kim | A47L 9/28 |
| 2017/0319036 | A1* | 11/2017 | Kim | H01M 10/44 |
| 2017/0319038 | A1 | 11/2017 | Kim et al. | |

(Continued)

FOREIGN PATENT DOCUMENTS

| | | |
|---|---|---|
| CN | 208926208 U | 6/2019 |
| JP | 2019-30458 A | 2/2019 |

(Continued)

OTHER PUBLICATIONS

Australian Examination Report No. 1 in counterpart Australian Application No. 2020289821, dated Aug. 10, 2021 (7 pages).

(Continued)

*Primary Examiner* — Joseph J Hail
*Assistant Examiner* — Dana Lee Poon
(74) *Attorney, Agent, or Firm* — Birch, Stewart, Kolasch & Birch, LLP

(57) ABSTRACT

A cleaning apparatus includes a vacuum cleaner, a stand, a first coupling portion, a plurality of suction units, and an extension holder. The vacuum cleaner includes a main body configured to receive and discharge air. The vacuum cleaner is mounted in the stand. The first coupling portion is formed in the stand and is positioned behind the vacuum cleaner. One of the suction units is selectively coupled to an air inlet through which air is suctioned into the main body. A first connector coupled to the first coupling portion is located at one end of each of the suction units. The extension holder includes a second connector and second coupling portions. The second connector is coupled to the first coupling portion. The second coupling portions are respectively positioned on either side of the second connector.

10 Claims, 11 Drawing Sheets

(56) References Cited

U.S. PATENT DOCUMENTS

| | | | | |
|---|---|---|---|---|
| 2017/0319039 | A1* | 11/2017 | Kim | A47L 9/2873 |
| 2018/0055320 | A1* | 3/2018 | Hwang | A47L 9/1683 |
| 2019/0274506 | A1 | 9/2019 | Kim et al. | |
| 2019/0365171 | A1* | 12/2019 | Ko | A47L 9/2873 |
| 2021/0345848 | A1* | 11/2021 | Jeon | A47L 5/28 |

FOREIGN PATENT DOCUMENTS

| | | | |
|---|---|---|---|
| KR | 2001-0068424 | | 7/2001 |
| KR | 10-2010-0138315 | | 12/2010 |
| KR | 10-2047109 | | 11/2019 |
| KR | 10-2061513 | | 1/2020 |
| TW | 201739408 | A | 11/2017 |
| WO | WO 2019/166763 | A1 | 9/2019 |

OTHER PUBLICATIONS

Office Action, dated Sep. 28, 2021, issued in Taiwanese Patent Application No. 109142665 (9 pages).

* cited by examiner

CLEANING APPARATUS

CROSS-REFERENCE TO RELATED APPLICATION

The present application claims the benefit of priority to Korean Patent Application No. 10-2020-0006623, entitled "CLEANING APPARATUS," filed on Jan. 17, 2020, in the Korean Intellectual Property Office, the entire disclosure of which is incorporated herein by reference.

TECHNICAL FIELD

The present disclosure relates to a cleaning apparatus and, more particularly, to a cleaning apparatus capable of storing multiple suction units of various shapes coupled thereto.

BACKGROUND

A vacuum cleaner causes air to flow in one direction, and filters dust and dirt included in the air while the air flows. Vacuum cleaners are generally divided into corded vacuum cleaners and cordless vacuum cleaners. A corded vacuum cleaner includes an electrical cord for receiving power from a power source, and is connected to the power source by means of the electrical cord. A cordless vacuum cleaner is equipped with a battery, and drives a motor by using electrical energy stored in the battery.

In general, the cordless vacuum cleaner is coupled to a stand to be stored. The battery of the cordless vacuum cleaner is charged while the cordless vacuum cleaner is mounted in the stand. The cordless vacuum cleaner and the stand should not occupy a large space when the vacuum cleaner is not being used, and should have a neat appearance while it is stored.

Vacuum cleaners suction up air at one side thereof, filter dust and dirt from the air, and discharge the filtered air through the other side thereof.

Here, various forms of suction units may be coupled to the one side of the vacuum cleaner at which air is suctioned up.

For example, a suction unit equipped with a roller for suctioning up dust from the floor, a suction unit formed in a long and slender shape so as to suction up dust from a narrow space, a suction unit equipped with bristles for cleaning a carpet, and the like may be coupled to the vacuum cleaner. The suction units may have various shapes suitable for cleaning various environments.

As the performance of vacuum cleaners has improved, the shapes of the suction units have diversified. However, as the shapes of the suction units diversify, and multiple suction units are used by a single vacuum cleaner, a separate space for storing the multiple suction units is required.

In relation to this, Korean Patent Application Publication No. 2001-0068424 (hereinafter referred to as "related art 1") discloses an accessory holder for a vacuum cleaner. In addition, Korean Patent Application Publication No. 2010-0138315 (hereinafter referred to as "related art 2") discloses a holder for a hose and an accessory, and an upright-type vacuum cleaner having the same.

Each of related art 1 and related art 2 discloses a holder for storing accessories (suction units) of different shapes from each other. The holders disclosed in related arts 1 and 2 are, however, fixed to a hose connected to the vacuum cleaner or to a main body of the vacuum cleaner.

Due to such a holder structure, when the vacuum cleaners of related arts 1 and 2 are operated, accessories stored in the holder may be moved. Accordingly, when the vacuum cleaners of the related arts are operated, the accessories stored in the holder may be separated from the holder. Furthermore, depending on the number of accessories coupled to the holder, the center of gravity of the holder may change, which may cause the holder to tilt to one side. Thus, the accessories may not be stably stored due to this phenomenon.

Moreover, the number of accessories that can be coupled to the holders of related arts 1 and 2 is limited, and is relatively small. Therefore, related arts 1 and 2 have a limitation in storing a plurality of accessories without spoiling the appearance of the vacuum cleaner.

SUMMARY

An aspect of the present disclosure is directed to providing a cleaning apparatus capable of storing a plurality of suction units.

Another aspect of the present disclosure is directed to providing a cleaning apparatus characterized in that even when a plurality of suction units are coupled thereto, the plurality of suction units do not occupy a large volume, and the appearance of the cleaning apparatus is kept neat.

Yet another aspect of the present disclosure is directed to providing a cleaning apparatus to which a plurality of cleaning units can be stably coupled and stored.

Still another aspect of the present disclosure is directed to providing a cleaning apparatus characterized in that a holder and a suction unit can be coupled to and decoupled from the cleaning apparatus by a simple motion of a user.

A cleaning apparatus according to an embodiment of the present disclosure may include an extension holder to which a plurality of suction units can be coupled, and as a vacuum cleaner and the extension holder are coupled in sequence to a stand, space may be efficiently used.

The extension holder may be positioned behind the vacuum cleaner when the vacuum cleaner is mounted in the stand. Since the extension holder has a shape extending in both directions, the extension holder may not occupy a large volume even when a plurality of suction units are coupled thereto.

As the extension holder is coupled to the stand on an imaginary line that vertically extends from a center of gravity of an auxiliary battery accommodated in the stand, a rotation force may not be applied to a second connector, which is a portion of the extension holder that is coupled to the stand, and thus the durability of the cleaning apparatus may be improved.

The cleaning apparatus according to an embodiment of the present disclosure may include the vacuum cleaner, the stand, a first coupling portion, the suction unit, and the extension holder.

The vacuum cleaner may include a main body configured to suction up and discharge air by using electrical energy stored in a battery. The battery, for operating a motor, may be provided within the main body.

The battery may be charged by receiving power from an external power source. The battery may be charged as the main body of the vacuum cleaner comes into contact with a charging terminal provided in the stand while the vacuum cleaner is mounted in the stand.

The vacuum cleaner may be mounted in the stand. The first coupling portion may be formed in the stand. The first coupling portion may be formed downward. The first coupling portion and a first connector may be coupled to each other.

The first coupling portion may be positioned behind the vacuum cleaner when the vacuum cleaner is mounted in the stand.

The suction unit may be provided as a plurality of suction units. One of the plurality of suction units may be selectively coupled to an air inlet through which air is suctioned into the main body.

The first connector, which is coupled to the first coupling portion, may be formed at one end of the suction unit. When the first connector formed in the suction unit is coupled to the first coupling portion, the suction unit may be mounted in a housing.

The extension holder may include a second connector and a second coupling portion. The second connector may be formed upward and may be coupled to the first coupling portion. The second coupling portion may be provided as at least one pair of second coupling portions, and the pair of second coupling portions may respectively be positioned on either side of the second connector.

The vacuum cleaner may include the main body, the air inlet, and an air outlet.

The motor and a filter may be accommodated in the main body. The air inlet may be formed at one side of the main body to form an entrance through which air is suctioned. The air outlet may be formed in the main body to form a passage through which the air that is suctioned through the air inlet is discharged from the main body.

The stand may include the housing, a mounting box, the charging terminal, and a guide.

The auxiliary battery may be accommodated within the housing. The auxiliary battery may be charged while accommodated within the housing. The mounting box may be formed in such a shape that a portion thereof that comes into contact with the main body corresponds to a shape of the main body.

The main body may be formed to be mounted on the housing. The charging terminal may be provided in the mounting box and may charge the battery by electrically contacting the main body.

The guide may be formed in the housing. The guide may come into contact with both sides of the main body at an upper portion of the mounting box to fix the main body.

The guide may guide the main body by restricting both sides of the main body such that the main body is correctly mounted on the mounting box. The mounting box may be formed in such a shape that the portion thereof that comes into contact with the main body corresponds to the shape of the main body.

The extension holder may include a first extension bar and second extension bars.

The first extension bar may have a horizontal length that is greater than a width of the housing. The second connector may be formed upward in a center of the first extension bar. The first extension bar may be formed to extend in a horizontal direction.

The second extension bars may respectively be provided at both ends of the first extension bar. The second extension bars may respectively extend in upward and downward directions from both ends of the first extension bar.

The second coupling portions may be formed at upper ends and lower ends of the second extension bars such that the second coupling portions face upwards at the upper ends of the second extension bars and face downwards at the lower ends of the second extension bars. The second coupling portions may be formed to be bilaterally symmetrical about the second connector.

A distance between the two second coupling portions formed at the upper ends of the second extension bars may be the same as or smaller than a horizontal length of a pedestal, and a distance between the two second coupling portions formed at the lower ends of the second extension bars may be the same as or smaller than the horizontal length of the pedestal. The second coupling portion may be positioned above the pedestal.

The extension holder may not protrude further than the pedestal in the horizontal direction. Accordingly, even when the stand is placed in a relatively narrow space in which the pedestal can barely fit, the extension holder may be used.

The distance between the two second coupling portions formed at the upper ends of the second extension bars may be smaller than the distance between the two second coupling portions formed at the lower ends of the second extension bars.

Suction units with a relatively small volume may be coupled to the second coupling portions that are formed at the upper ends of the second extension bars. Accordingly, a volume occupied in the space beside the main body by the suction units with the relatively small volume may be reduced.

Suction units with a relatively large volume may be coupled to the second coupling portions that are formed at the lower ends of the second extension bars. Accordingly, when four suction units are coupled to the four second coupling portions of the second extension bars, a center of gravity of the four suction units may be positioned below the first coupling portion and the first extension bar. Accordingly, even when an external shock is applied to the extension holder and the suction units coupled thereto, movement thereof may be minimized due to the relatively low center of gravity.

The stand may include the pedestal and a pillar.

The pedestal may be in contact with a predetermined area of a floor.

The pillar may be coupled to an upper surface of the pedestal. The pillar may be formed to have a predetermined length in a vertical direction. The housing may be coupled to an upper end of the pillar so as to be supported by the pillar and the pedestal.

At least one first coupling portion may be formed on a bottom surface of the housing. The first coupling portion may be formed downward. The first coupling portion may be positioned between the vacuum cleaner and the pillar when the vacuum cleaner is mounted in the stand.

Two first coupling portions may be formed on the bottom surface of the housing. The suction unit or the extension holder may be coupled to each of the two first coupling portions. The two first coupling portions may be disposed on an imaginary line that connects the vacuum cleaner and the pillar.

The first coupling portion may be formed on the imaginary line that vertically extends from the center of gravity of the auxiliary battery accommodated in the housing. The center of gravity of the auxiliary battery may be positioned above the first coupling portion.

Accordingly, when the plurality of suction units are coupled to the extension holder, a center of gravity of the suction units may be positioned below the center of gravity of the auxiliary battery. Accordingly, the risk of overturning of the stand caused by a horizontal external force may be minimized.

According to embodiments of the present disclosure, when the extension holder is coupled to the stand, a plurality of second coupling portions may be formed by the single extension holder, and thus a plurality of suction units may be stored in the stand by coupling the plurality of suction units to the stand.

According to the embodiments of the present disclosure, since the extension holder does not protrude further than the pedestal in the horizontal direction while the extension holder is coupled to the stand, the extension holder may be freely used even when the stand is placed in a relatively narrow space in which the pedestal can barely fit.

According to the embodiments of the present disclosure, since the center of gravity of the suction units is below the center of gravity of the auxiliary battery while the plurality of suction units are coupled to the extension holder, the risk of overturning of the stand caused by a horizontal external force may be minimized.

According to the embodiments of the present disclosure, as a first release button is formed in the first connector, and a second release button is formed in the second connector, the first connector or the second connector may be decoupled from the first coupling portion or the second coupling portion with a motion of pushing the first release button or the second release button only once.

BRIEF DESCRIPTION OF THE DRAWINGS

The foregoing and other aspects, features, and advantages of the disclosure, as well as the following detailed description of the embodiments, will be better understood when read in conjunction with the accompanying drawings. For the purpose of illustrating the present disclosure, there is shown in the drawings an exemplary embodiment, it being understood, however, that the present disclosure is not intended to be limited to the details shown because various modifications and structural changes may be made therein without departing from the spirit of the present disclosure and within the scope and range of equivalents of the claims. The use of the same reference numerals or symbols in different drawings indicates similar or identical items.

DETAILED DESCRIPTION

Figure 1:
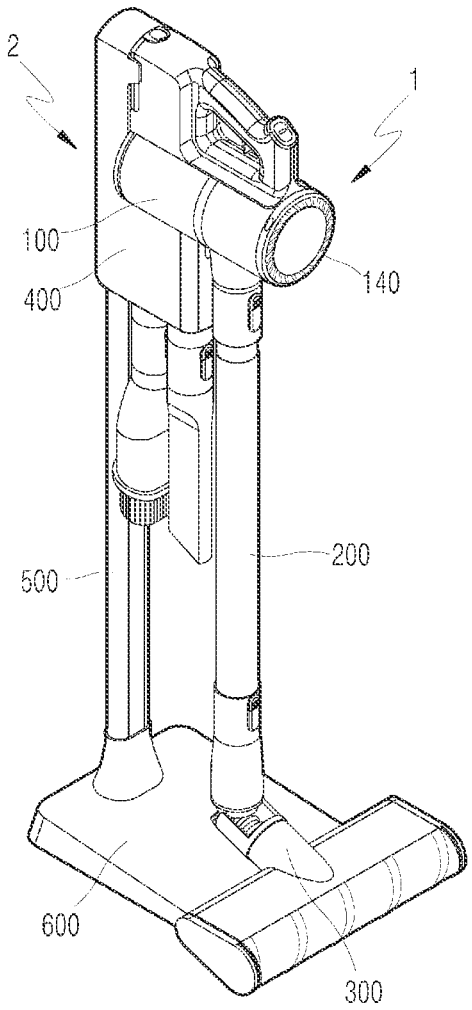
FIG. 1 is a perspective view of a cleaning apparatus according to an embodiment of the present disclosure.

Advantages and features of the present disclosure and methods for achieving them will become apparent from the descriptions of aspects herein below with reference to the accompanying drawings. However, the present disclosure is not limited to the aspects disclosed herein but may be implemented in various different forms. The aspects are provided to make the description of the present disclosure thorough and to fully convey the scope of the present disclosure to those skilled in the art. It is to be noted that the scope of the present disclosure is defined only by the claims.

The shapes, sizes, ratios, angles, the number of elements given in the drawings are merely exemplary, and thus, the present disclosure is not limited to the illustrated details. Like reference numerals designate like elements throughout the specification.

In relation to describing the present disclosure, when the detailed description of the relevant known technology is determined to unnecessarily obscure the gist of the present disclosure, the detailed description may be omitted.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms "connected" and "coupled" are not restricted to physical or mechanical connections or couplings, and can include electrical connections or couplings, whether direct or indirect. The connection can be such that the objects are permanently connected or releasably connected. The term "communicatively coupled" is defined as connected, either directly or indirectly through intervening components, and the connections are not necessarily limited to physical connections, but are connections that accommodate the transfer of data, fluids, or other matter between the so-described components.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Hereinafter, preferable exemplary embodiments of the present disclosure will be described in detail referring to the attached drawings. In the following description, known functions or features will be omitted in order to clarify the gist of the present disclosure.

Figure 2:
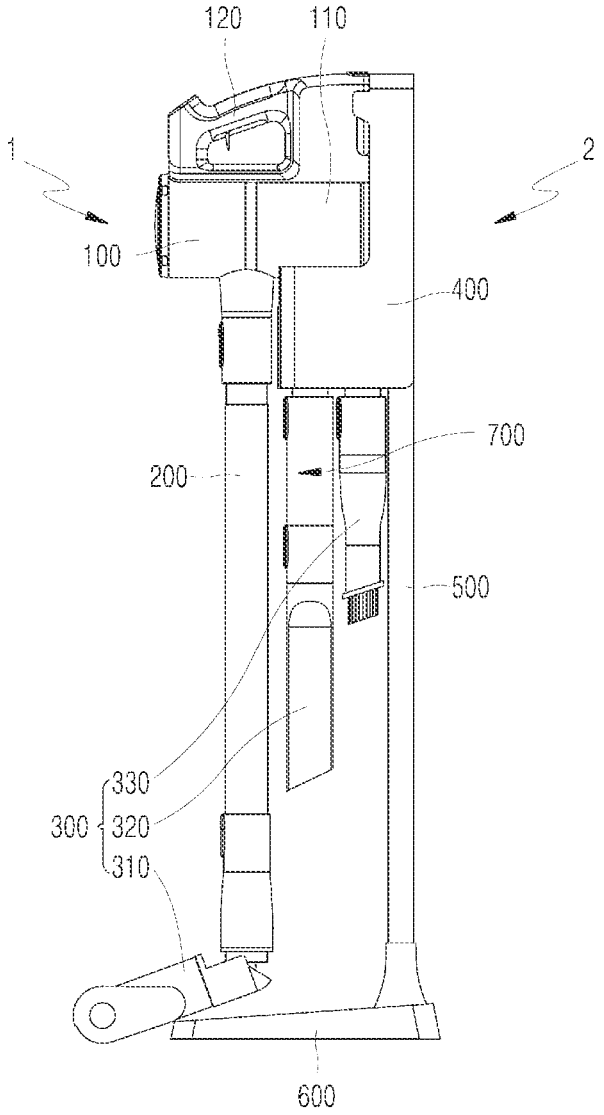
FIG. 2 is a side view of the cleaning apparatus of FIG. 1.

FIG. 1 is a perspective view of a cleaning apparatus according to an embodiment of the present disclosure. FIG. 2 is a side view of the cleaning apparatus of FIG. 1.

As illustrated in FIGS. 1 and 2, the cleaning apparatus according to an embodiment of the present disclosure may include a vacuum cleaner 1, a stand 2, and an extension holder 700.

The stand 2 may be fixed to a surface of a wall or a floor. The vacuum cleaner 1 may be mounted in the stand 2. The stand 2 may stably support the vacuum cleaner 1 and, at the same time, may charge a battery provided in the vacuum cleaner 1 or an auxiliary battery 430.

The vacuum cleaner 1 may include a main body 100, a dust container 110, a handle 120, and an extension pipe 200.

The main body 100 may include a motor configured to generate a pressure difference or form an air flow. The motor may suction up air to the inside of the main body 100, and the suctioned-up air may pass through the main body 100 to be discharged back to the outside.

At least one filter may be provided inside the main body 100. The filter may be disposed in a passage through which the air is suctioned and discharged, and may filter foreign substances such as dust and dirt included in the flowing air. The filter may be provided as a plurality of filters depending on the purpose.

For example, a plurality of filters for filtering different sizes of particles may be disposed on the passage of the flowing air. The structure and element for flowing air and filtering foreign substances may be variously embodied depending on the embodiments of the present disclosure.

The main body 100 may include the motor and the filter. The motor and the filter may enable air to flow and filter foreign substances. An air inlet 130 may be formed at one side of the main body 100. In addition, an air outlet 140 for discharging air may also be formed in the main body 100.

The main body 100 may include the dust container 110 and the handle 120.

The dust container 110 may be a container in which dust and dirt separated from the air by the filter are collected. The dust container 110 may be detachably coupled to the main body 100. The dust container 110 may be made of a transparent material such that the collected dust and dirt can be seen from outside.

The handle 120 may be formed at one side of the main body 100. Specifically, the handle 120 may be formed in the main body 100 at the opposite side to the air inlet 130. The handle 120 may be formed on the basis of a center of gravity of the main body 100 such that, when a user grips the handle 120, the user can easily move and control the vacuum cleaner 1.

A control button for controlling the vacuum cleaner 1 may be provided in a position of the vacuum cleaner 1 adjacent to the handle 120.

The battery for operating the motor may be provided within the main body 100. The battery may store a predetermined amount of electrical energy through a charging process. Charging of the battery may be performed by receiving power from an external power source. The charging of the battery may be performed as the main body 100 of the vacuum cleaner 1 comes into contact with a charging terminal 440 provided in the stand 2 while the vacuum cleaner 1 is mounted in the stand 2.

The air inlet 130 may be formed at one side of the main body 100. The air inlet 130 may protrude outwards from the main body 100. A coupling groove 132 to which the extension pipe 200 or the suction unit 300 can be coupled may be formed in the air inlet 130. Specifically, the air inlet 130 may be formed in a shape that can be coupled to the extension pipe 200 or a first connector 302 of the suction unit 300.

The air inlet 130 may be coupled to the extension pipe 200. Alternatively, the air inlet 130 may be directly coupled to the suction unit 300. The extension pipe 200 may be coupled to the air inlet 130 at one end of the extension pipe 200, and may be coupled to the first connector 302 of the suction unit 300 at the other end thereof.

A passage may be formed within the extension pipe 200 such that air flows therethrough. Accordingly, the extension pipe 200 may space the main body 100 and the suction unit 300 from each other by a certain distance. The extension pipe 200 may be formed in the form of a pipe. Alternatively, the extension pipe 200 may be formed of a flexible pipe.

The suction unit 300 may be directly connected to the air inlet 130 formed in the main body 100 or may be coupled to an end of the extension pipe 200. The suction unit 300 may form an entrance through which the suctioned-up air flows into the main body 100.

The suction unit 300 may be formed in various shapes depending on the purpose of cleaning. Accordingly, a plurality of suction units 300 may be provided. The user may couple one of the plurality of suction units 300 to the main body 100 to use it.

Specifically, the suction units 300 may be formed in various shapes suitable for cleaning, for example, a floor, a mattress, a carpet, narrow spaces under furniture, etc. The suction units 300 may include a first suction unit 310, a second suction unit 320, and a third suction unit 330.

The first suction unit 310 among the suction units 300 may be selectively coupled to the main body 100, and the second suction unit 320 and the third suction unit 330 may be coupled to the stand 2 to be stored.

That is, while one of the suction units 300 is coupled to the main body 100 and performs a cleaning, the other suction units 300 that are not being used may be separately stored. The suction units 300 may be coupled to the extension holder 700. The suction units 300 may be mounted in the extension holder 700 coupled to the stand 2.

Figure 3:
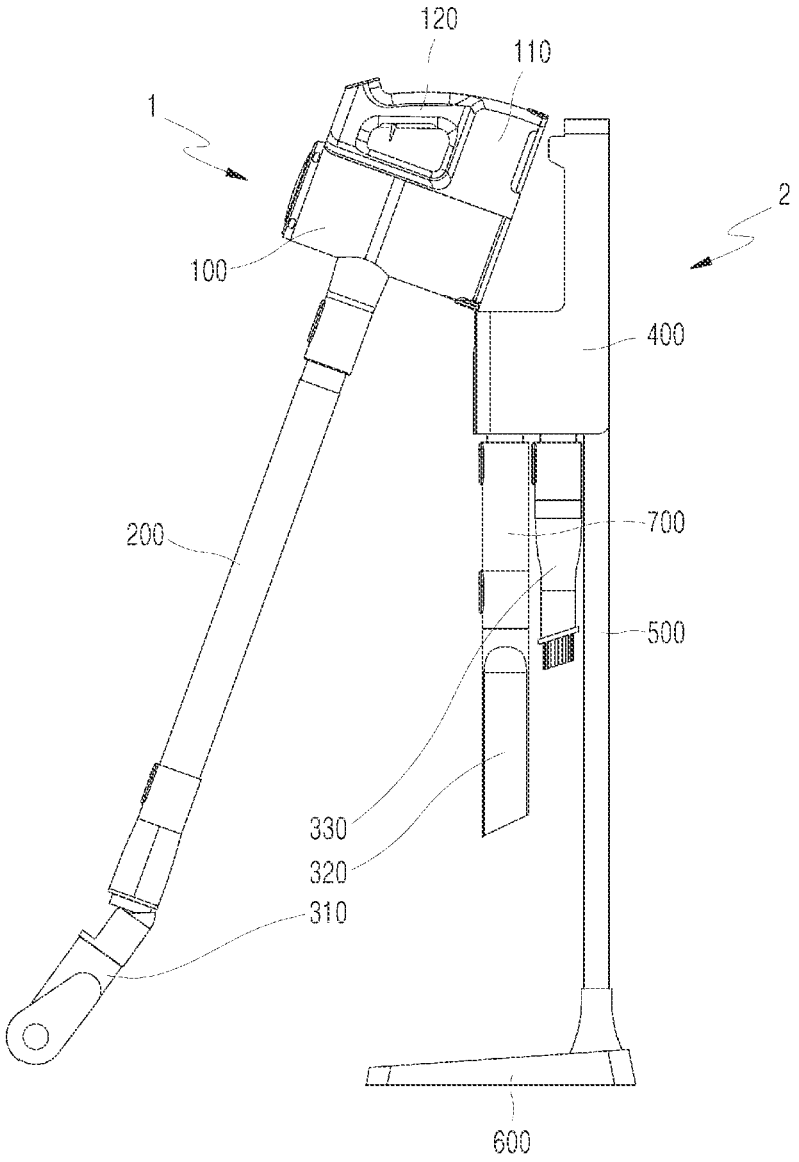
FIG. 3 is a side view of the cleaning apparatus of FIG. 1.
Figure 4:
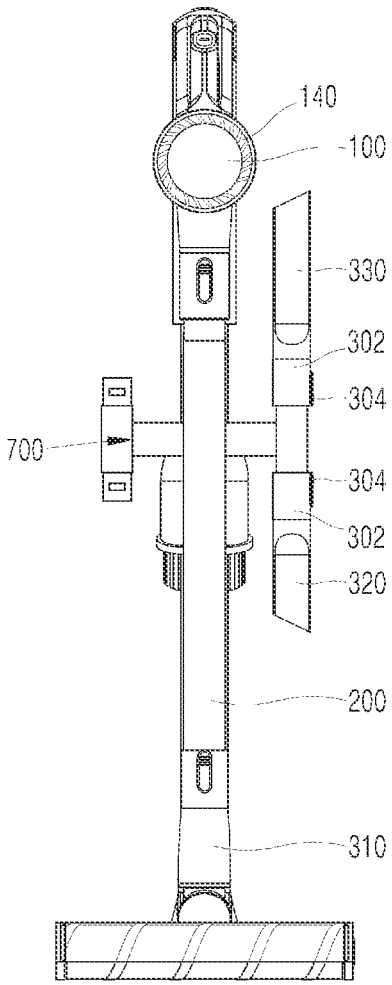
FIG. 4 is a front view of the cleaning apparatus according to an embodiment of the present disclosure.
Figure 5:
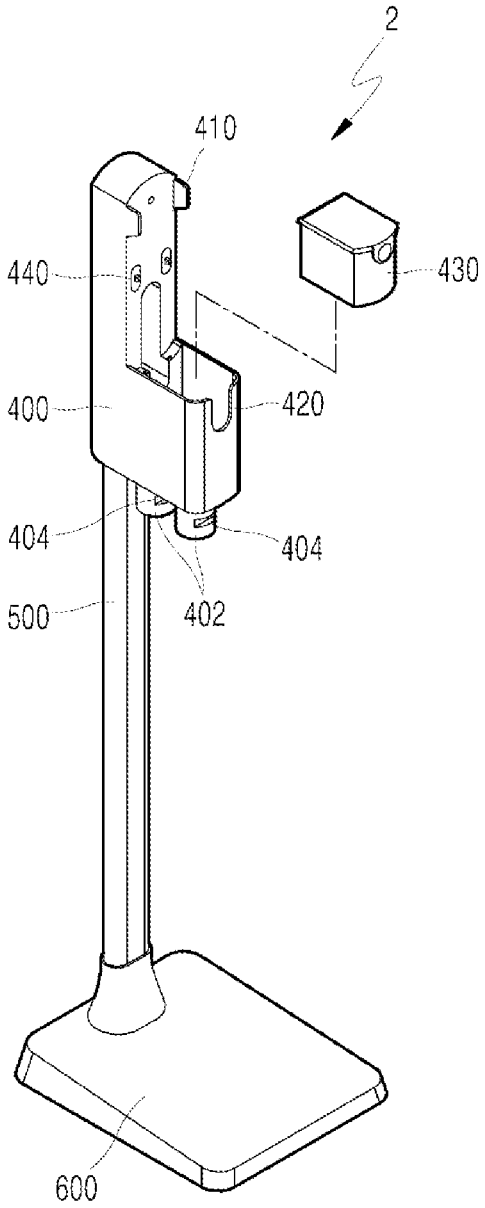
FIG. 5 is a perspective view of a stand of the cleaning apparatus of FIG. 1.

FIG. 3 is a side view of the cleaning apparatus of FIG. 1. FIG. 4 is a front view of the cleaning apparatus according to an embodiment of the present disclosure. FIG. 5 is a perspective view of the stand of the cleaning apparatus of FIG. 1. As illustrated in FIGS. 3 to 5, the vacuum cleaner 1 may be mounted in the stand 2 to be stored, or may be separated from the stand 2 to perform cleaning.

The stand 2 may include a housing 400, a pillar 500, and a pedestal 600. The housing 400 of the stand 2 may be fixed to a wall or to a structure.

The housing 400 may be positioned at a certain height by the pillar 500 and the pedestal 600. The weight of the housing 400 may be supported by the pillar 500 and the pedestal 600, and thus may be stably fixed.

As illustrated in FIG. 5, the housing 400 may include a guide 410 and a mounting box 420 such that the main body 100 of the vacuum cleaner 1 is placed on a front surface of the housing 400.

The guide 410 may guide the main body 100 by restricting both sides of the main body 100 such that the main body 100 is correctly placed in the mounting box 420. The mounting box 420 may be formed in such a shape that a portion of the mounting box 420 that comes into contact with the main body 100 corresponds to a shape of the main body 100.

Accordingly, when the main body 100, of which both sides are restricted by the guide 410, is lowered into the mounting box 420, the main body 100 is mounted in the mounting box 420, which is formed in the shape corresponding to the shape of the main body 100.

When the main body 100 is mounted in the mounting box 420, the vacuum cleaner 1 may not deviate from the stand 2, except when an external force is applied in a predetermined direction.

A space may be formed in the housing 400. The space formed in the housing 400 may be open to the outside, that is, may be open upwards through the mounting box 420. The auxiliary battery 430 may be accommodated in the open space of the housing 400. The auxiliary battery 430 may be charged while accommodated in the housing 400.

As illustrated in FIG. 5, the mounting box 420 may be provided with the charging terminal 440 for passing current to the main body 100 of the vacuum cleaner 1. The charging terminal 440 may charge the battery provided in the main body 100 by applying current to the battery while the vacuum cleaner 1 is mounted in the stand 2.

Accordingly, the battery in the main body 100 may be charged while the vacuum cleaner 1 is mounted in the stand 2. Alternatively, the auxiliary battery 430 may be mounted and used. However, the battery or the auxiliary battery 430 for driving the motor of the vacuum cleaner 1 is not limited thereto, and may be embodied in various forms.

The housing 400 may be coupled to the pillar 500 and the pedestal 600, and may be positioned at a certain height from the floor. The pedestal 600 may be a plate-shaped member with a relatively large bottom surface. The pedestal 600 may be in contact with the floor so as to stably support the pillar 500 and the housing 400.

A lower end of the pillar 500 may be coupled to the pedestal 600. The pillar 500 may have a rod shape extending vertically, and an upper end of the pillar 500 may be coupled to the housing 400 to support the housing 400.

As illustrated in FIG. 5, at least one first coupling portion 402 may be formed on a bottom surface of the housing 400. The first coupling portion 402 may be formed downwardly.

The first coupling portion 402 may be formed so as to be coupled to the first connector 302. The first connector 302 may be formed in the suction unit 300. When the first connector 302 formed in the suction unit 300 is coupled to the first coupling portion 402, the suction unit 300 may be mounted in the housing 400.

The extension holder 700 may be coupled to the first coupling portion 402. A second connector 712 formed in the extension holder 700 may be coupled to the first coupling portion 402. The second connector 712 may have the same shape and structure as those of the first connector 302.

The extension holder 700 may include a single second connector 712 and a plurality of second coupling portions 722. The extension holder 700 may be coupled to the first coupling portion 402, and may provide the plurality of second coupling portions 722 of the same shape and structure as those of the first coupling portion 402.

That is, when the extension holder 700 is coupled to the first coupling portion 402, a plurality of suction units 300 may respectively be coupled to each of the plurality of second coupling portions 722.

The first coupling portion 402 may be formed on an imaginary line that vertically extends from a center of gravity of the auxiliary battery 430 accommodated in the housing 400. That is, a center of gravity of the first coupling portion 402 may be on the imaginary line that vertically extends from the center of gravity of the auxiliary battery 430, which is relatively heavy.

When the plurality of suction units 300 are coupled to the extension holder 700, a center of gravity of the plurality of suction units 300 may be positioned below the center of gravity of the auxiliary battery 430. Accordingly, the risk of overturning of the stand 2 caused by a horizontal external force may be minimized.

A plurality of first coupling portions 402 may be formed on the imaginary line that vertically extends from the center of gravity of the auxiliary battery 430.

That is, at least two first coupling portions 402 may be formed on the imaginary line that vertically extends from the center of gravity of the auxiliary battery 430. In addition, the suction units 300 or the extension holder 700 may be coupled to each of the first coupling portions 402.

The first coupling portion 402 and the second coupling portions 722 may have the same shape and structure as each other. Also, the first connector 302 and the second connector 712 may have the same shape and structure as each other.

The first coupling portion 402 may be formed in the housing 400 of the stand 2, and may be coupled to the first connector 302 or the second connector 712.

The second coupling portions 722 may be formed in the extension holder 700, and may be coupled to the first connector 302 or the second connector 712. Accordingly, a second connector 712 of another extension holder 700 may be coupled to the second coupling portions 722 formed in the extension holder 700. A single coupling portion may be expanded to a plurality of coupling portions through the extension holder 700. That is, a plurality of coupling portions may branch off from the extension holder 700.

FIGS. 6 to 9 are front views of the extension holder of the cleaning apparatus of FIG. 1.

As illustrated in FIGS. 6 to 9, the extension holder 700 may be formed in various shapes.

Figure 6:
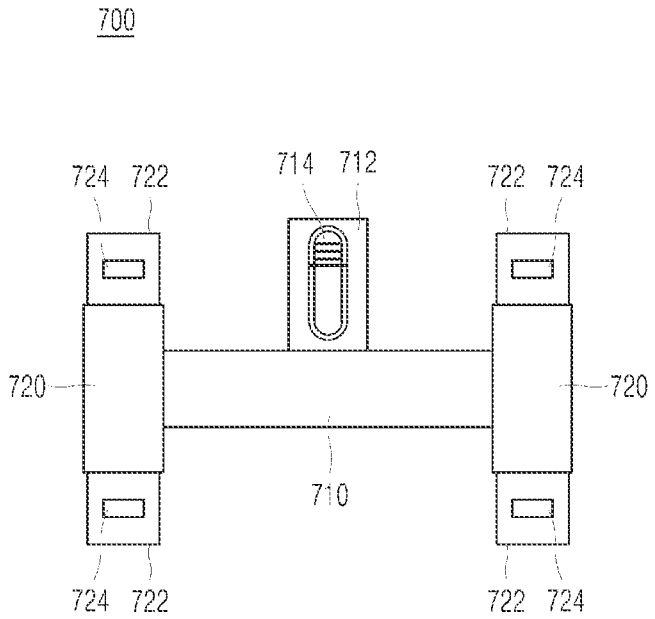
FIGS. 6 to 9 are front views of an extension holder of the cleaning apparatus of FIG. 1.

As illustrated in FIG. 6, the extension holder 700 may include a first extension bar 710 and second extension bars 720.

The first extension bar 710 may be formed to extend in a horizontal direction. The second connector 712 may be formed upward in a center of the first extension bar 710. The second extension bars 720 may respectively be provided at both ends of the first extension bar 710. The second extension bars 720 may be formed to extend in a vertical direction. The second extension bars 720 may respectively be provided at both ends of the first extension bar 710.

The second coupling portions 722 may be formed at upper ends and lower ends of the second extension bars 720. The second coupling portions 722 that are formed at the upper ends of the second extension bars 720 may be formed to face upwards. The second coupling portions 722 that are formed at the lower ends of the second extension bars 720 may be formed to face downwards.

Accordingly, a total of four second coupling portions 722 may be provided in a single extension holder 700. The suction units 300 may respectively be mounted in each of the second coupling portions 722.

A distance between two second coupling portions 722 formed at the upper ends of the second extension bars 720 may be the same as or smaller than a horizontal length of the pedestal 600, and a distance between two second coupling portions 722 formed at the lower ends of the second extension bars 720 may be the same as or smaller than the horizontal length of the pedestal 600. The second coupling portion 722 may be positioned above the pedestal 600.

Accordingly, the extension holder 700 may not protrude further than the pedestal 600 in the horizontal direction. Accordingly, there is an advantage that the extension holder 700 may be used even when the stand 2 is placed in a relatively narrow space in which the pedestal 600 can barely fit.

Figure 7:
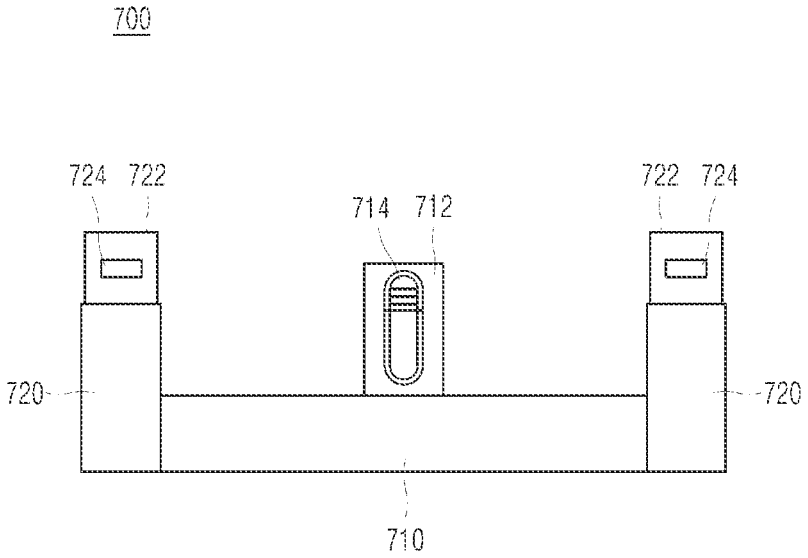

As illustrated in FIG. 7, the second coupling portions 722 may respectively be formed at an end of each the second extension bars 720. The second coupling portions 722 may be formed upward.

When the second connector 712 is coupled to the first coupling portion 402, a suction unit 300 that is coupled to a second coupling portion 722 may be decoupled by lifting the suction unit 300. Accordingly, only the suction unit 300 may be separated in a direction in which the second connector 712 and the first coupling portion 402 are coupled.

Figure 8:
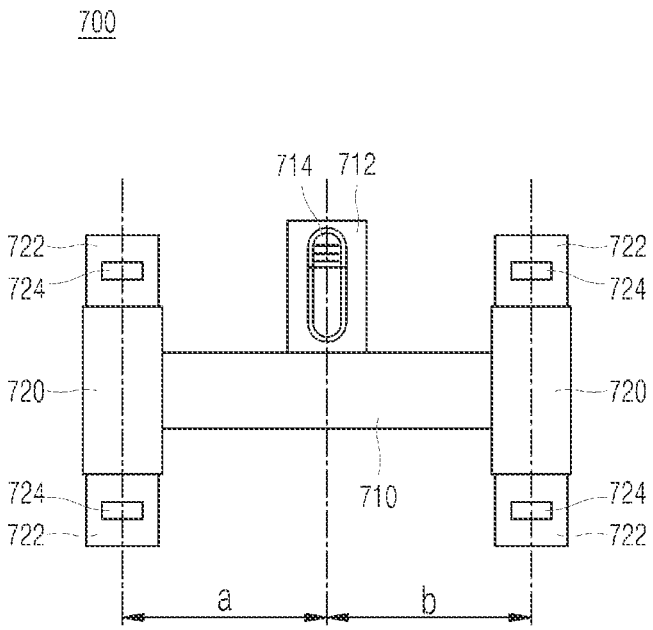

As illustrated in FIG. 8, the second extension bars 720 formed at both ends of the first extension bar 710 may be formed such that the second connector 712 is positioned in the center between the second extension bars 720. That is, a distance (a) between the second connector 712 and one of the second extension bars 720 may be the same as a distance (b) between the second connector 712 and the other of the second extension bars 720.

When two suction units 300 of the same or similar weight are coupled to each of the second extension bars 720, the center of gravity may be positioned in the second connector 712 coupled to the first coupling portion 402, and thus the coupling state of the extension holder 700 may be more stably maintained.

Figure 9:
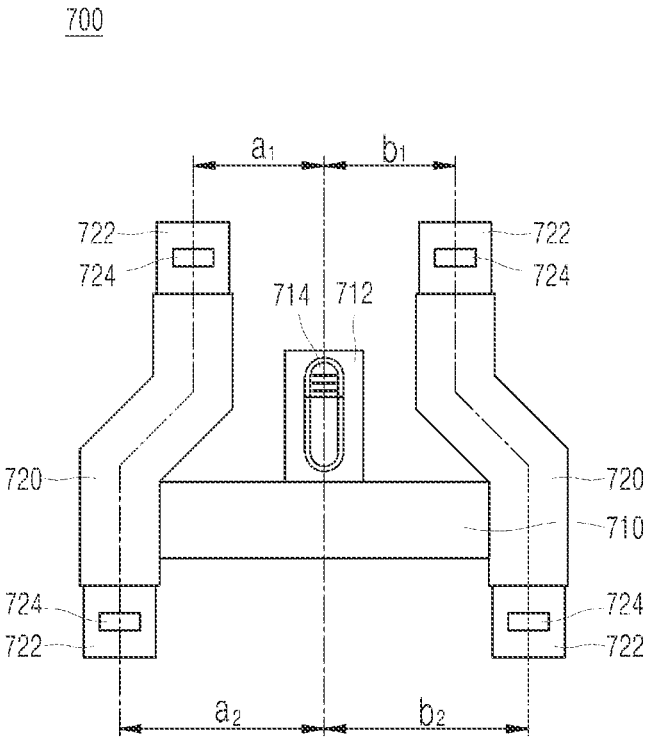

As illustrated in FIG. 9, a distance (a2+b2) between the second coupling portions 722 that are formed at the lower ends of the second extension bars 720 may be greater than a distance (a1+b1) between the second coupling portions 722 that are formed at the upper ends of the second extension bars 720.

Suction units 300 with a relatively small volume may be coupled to the second coupling portions 722 that are positioned above the first extension bar 710. Accordingly, a volume occupied by the suction units 300 with the relatively small volume in the space beside the main body 100 may be reduced.

Suction units 300 with a relatively large volume may be coupled to the second coupling portions 722 that are positioned below the first extension bar 710. A weight of the suction unit 300 may generally be proportional to the volume thereof.

Accordingly, when four suction units 300 are coupled to the four second coupling portions 722 of the two second extension bars 720, the center of gravity of the four suction units 300 may be positioned below the first coupling portion 402 and the first extension bar 710. Accordingly, even when an external shock is applied to the extension holder 700 and the suction units 300 coupled thereto, movement thereof may be minimized due to the relatively low center of gravity.

Figure 10:
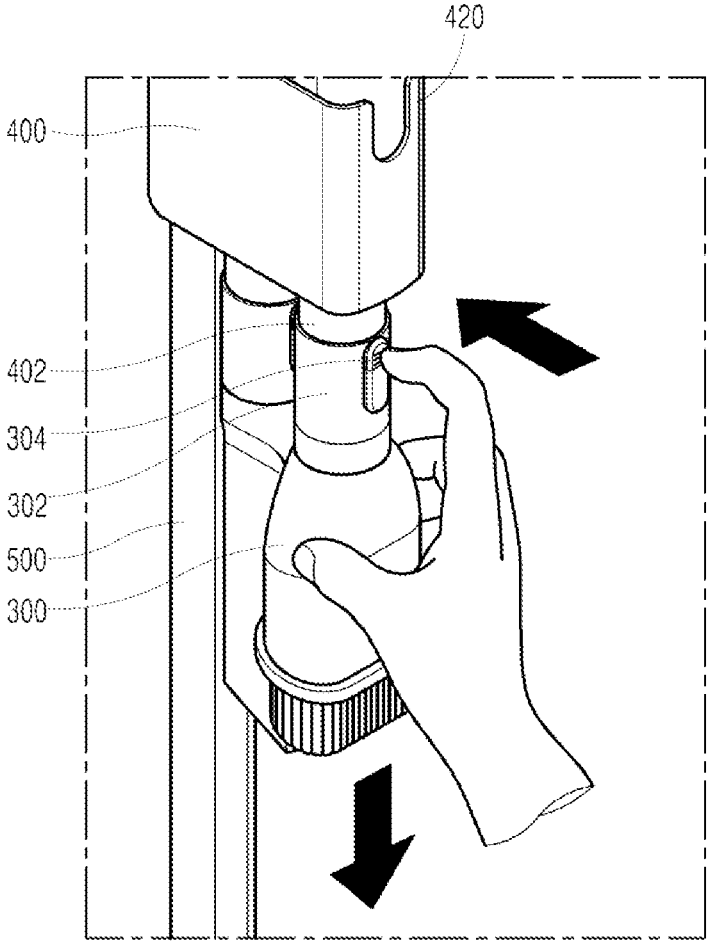
FIG. 10 is a view illustrating a state in which a suction unit is being coupled to or decoupled from the stand in the cleaning apparatus of FIG. 1.

FIG. 10 is a view illustrating a state in which a suction unit is being coupled to or decoupled from the stand in the cleaning apparatus of FIG. 1. As illustrated in FIG. 10, a first release button 304 may be formed in the first connector 302. In addition, a first coupling groove 404 may be formed in the first coupling portion 402. In addition, a second release button 714 may be formed in the second connector 712. Furthermore, a second coupling groove 724 may be formed in the second coupling portion 722. The first connector 302 and the second connector 712 may have the same structure and shape as each other, and the first coupling portion 402 and the second coupling portion 722 may have the same structure and shape as each other.

When the user pushes the first release button 304, a coupling between the first coupling portion 402 and the second coupling groove 724 of the second coupling portion 722 may be released. The second coupling groove 724 may be formed in the shape of a recessed groove.

Accordingly, with a motion of pushing the first release button 304 or the second release button 714 only once, the first connector 302 or the second connector 712 may be decoupled from the first coupling portion 402 or the second coupling portion 722.

Figure 11:
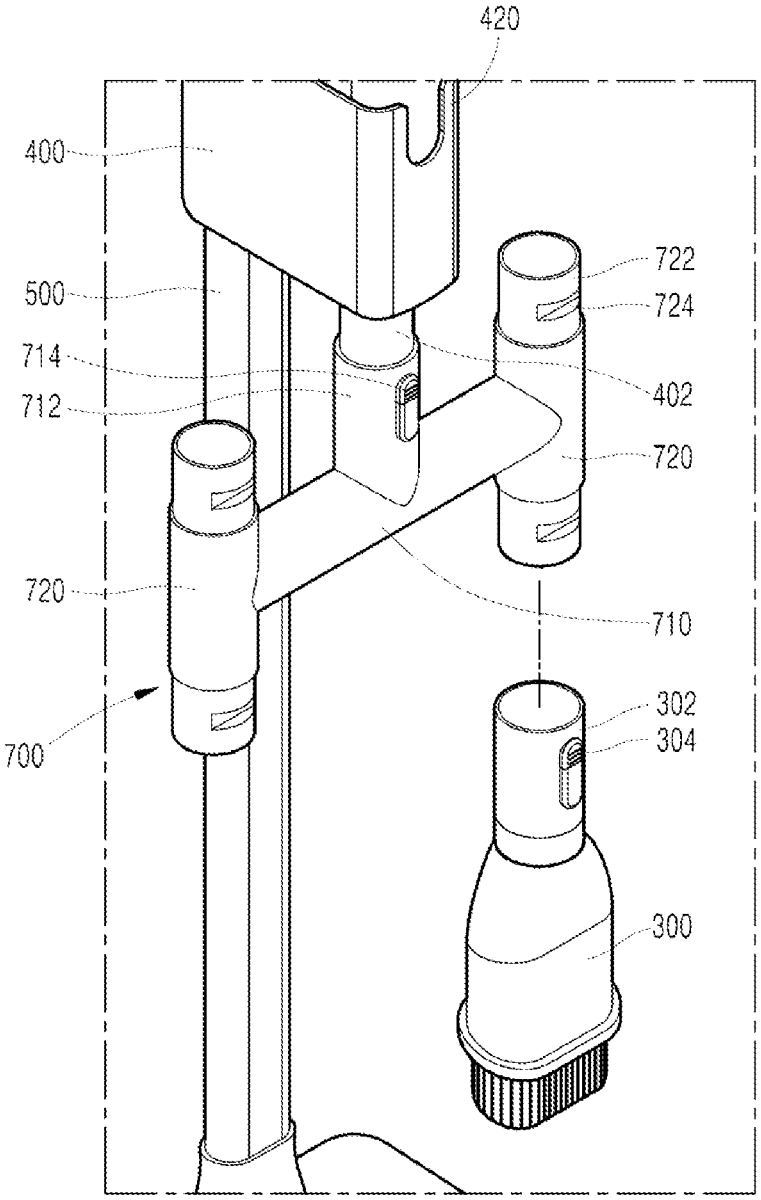
FIG. 11 is a view illustrating a state in which the suction unit is being coupled to or decoupled from the extension holder in the cleaning apparatus of FIG. 4.

FIG. 11 is a view illustrating a state in which the suction unit is being coupled to or decoupled from the extension holder in the cleaning apparatus of FIG. 4.

As illustrated in FIG. 11, when the second connector 712 is coupled to the first coupling portion 402, the extension holder 700 may be mounted in the stand 2. A suction unit 300 or another extension holder 700 may be coupled to the second coupling portions 722 formed in the extension holder 700.

Accordingly, when the extension holder 700 is coupled to the first coupling portion 402, a plurality of second coupling portions 722 may be formed. A suction unit 300 or a third extension holder 700 may be coupled to each of the plurality of second coupling portions 722.

Figure 12:
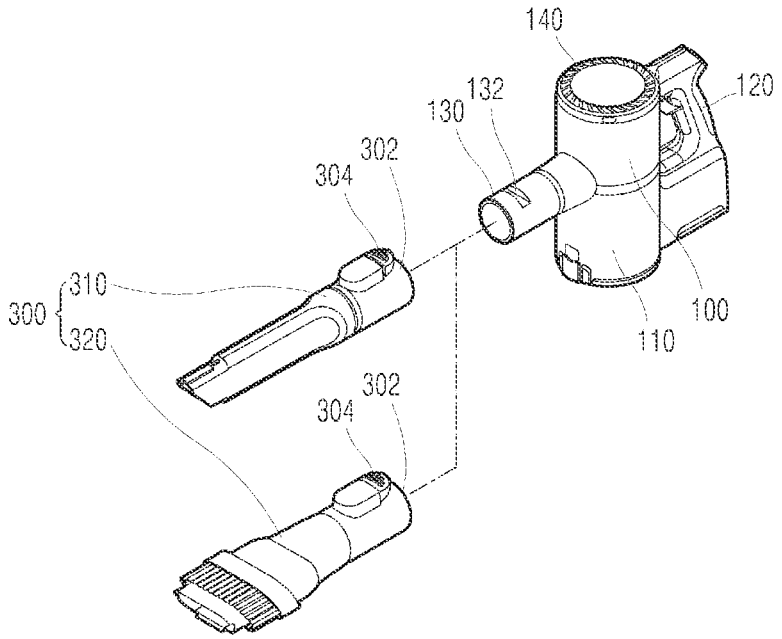
FIG. 12 is a view illustrating a state in which the suction unit is being coupled to or decoupled from a main body of the cleaning apparatus of FIG. 1.
Figure 13:
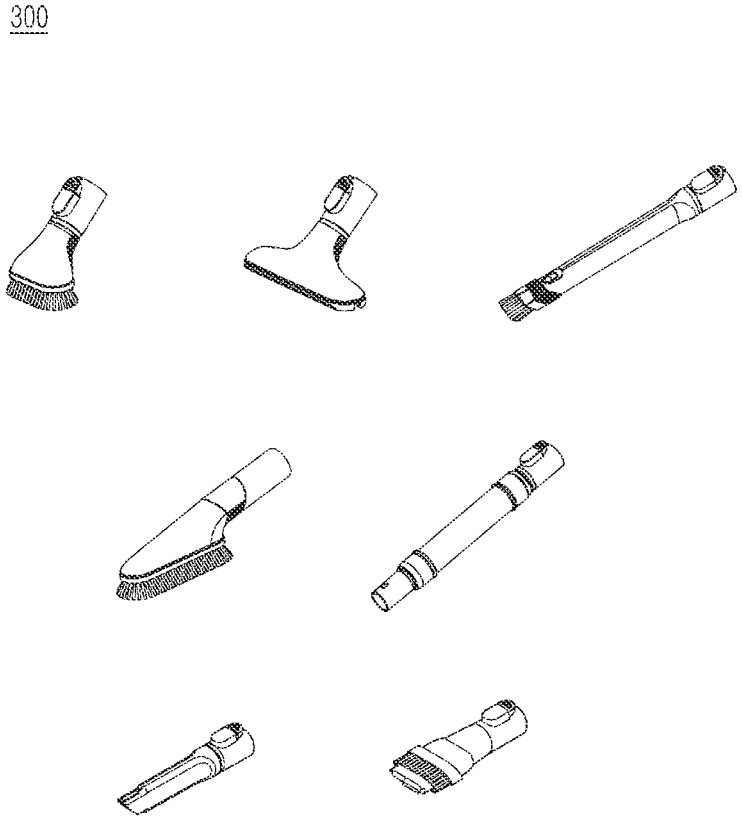
FIG. 13 is a perspective view of suction units of the cleaning apparatus of FIG. 1.

FIG. 12 is a view illustrating a state in which the suction unit is being coupled to or decoupled from the main body of the cleaning apparatus of FIG. 1. FIG. 13 is a perspective view of suction units of the cleaning apparatus of FIG. 1.

As illustrated in FIGS. 12 and 13, the suction units 300 may be formed in various shapes for different functions. The user may select, from among the plurality of suction units 300, one suction unit 300 suitable for the purpose of the cleaning, and may couple the selected suction unit 300 to the air inlet 130 of the main body 100 of the vacuum cleaner 1.

A distance between the suction unit 300 and the main body 200 may be adjusted through the extension pipe 200. One suction unit 300 may be selectively coupled to the main body 100, and the other suction units 300 may be mounted in the stand 2 through the extension holder 700 as described in detail above.

While specific exemplary embodiments of the present disclosure are described and illustrated above, it would be obvious to those skilled in the art that various modifications and variations can be made thereto within the spirit and scope of the present disclosure. Accordingly, such modifications or variations are not to be regarded as a departure from the spirit or scope of the present disclosure, and it is intended that the present disclosure cover the modifications and variations of the present disclosure provided they come within the scope of the appended claims and their equivalents.

What is claimed is:

1. A cleaning apparatus comprising:

a vacuum cleaner comprising a main body and an air inlet through which air is suctioned into the main body;

a stand configured to mount the vacuum cleaner, the stand comprising a housing configured to accommodate an auxiliary battery;

a first coupling portion formed in the stand and positioned between the vacuum cleaner and the stand when the vacuum cleaner is mounted in the stand;

a plurality of suction units, wherein each of the suction units includes a first connector configured to be coupled to the first coupling portion, and wherein one of the suction units is configured to be selectively coupled to the air inlet;

an extension holder comprising a second connector coupled to the first coupling portion; and at least one pair of second coupling portions respectively positioned on either side of the second connector, wherein the extension holder comprises:

a first extension bar having a horizontal length greater than a width of the housing, wherein the second connector is formed adjacent to a center of the first extension bar; and second extension bars respectively extending from both ends of the first extension bar in a vertical direction, wherein the at least one pair of second coupling portions includes a first pair of second coupling portions and a second pair of coupling portions respectively formed at upper ends and lower ends of the second extension bars such that the first pair of second coupling portions face upwards adjacent the upper ends of the second extension bars and the second pair of second coupling portions face downwards adjacent the lower ends of the second extension bars.

2. The cleaning apparatus of claim 1, wherein the stand comprises:

a pedestal configured to be in contact with a floor; and a pillar coupled to an upper surface of the pedestal and having a predetermined length in a vertical direction, wherein the first coupling portion is formed adjacent to a lower portion of the housing, and a distance between the at least one pair of second coupling portions is equal to or smaller than a horizontal length of the pedestal.

3. The cleaning apparatus of claim 1, wherein the vacuum cleaner comprises:

a motor and a filter accommodated in the main body;

the air inlet formed on one side of the main body; and an air outlet formed in the main body and configured to discharge the air.

4. The cleaning apparatus of claim 1, wherein the stand comprises:

a mounting box configured to mount the main body, a portion of the mounting box that comes into contact with the main body having a shape that corresponds to a shape of the main body;

a charging terminal provided in the mounting box and configured to charge the auxiliary battery by electrically contacting the main body; and a guide formed in the housing and configured to position the main body, the guide being configured to contact both sides of the main body adjacent to an upper portion of the mounting box.

5. The cleaning apparatus of claim 1, wherein the first and second pair of second coupling portions are formed to be bilaterally symmetrical about the second connector.

6. The cleaning apparatus of claim 1, wherein a first distance between the first pair of second coupling portions is smaller than a second distance between the second pair of second coupling portions.

7. The cleaning apparatus of claim 4, wherein the stand further comprises:

a pedestal configured to be in contact with a predetermined area of a floor; and a pillar coupled to an upper surface of the pedestal and having a predetermined length in a vertical direction, wherein the housing is coupled to an upper end of the pillar.

8. The cleaning apparatus of claim 7, wherein the first coupling portion is formed on a bottom surface of the housing, the first coupling portion being positioned between the vacuum cleaner and the pillar when the vacuum cleaner is mounted in the stand.

9. The cleaning apparatus of claim 8, wherein the first coupling portion includes two first coupling portions formed on the bottom surface of the housing and disposed on an imaginary line that connects the vacuum cleaner and the pillar.

10. The cleaning apparatus of claim 4, wherein a center of gravity of the auxiliary battery is positioned above the first coupling portion.

* * * * *